United States Patent [19]

Mock et al.

[11] Patent Number: 5,044,398

[45] Date of Patent: Sep. 3, 1991

[54] CONTROL VALVE FOR COUNTERBLOW-TAP HOLE-BORING MACHINE

[75] Inventors: Franz Mock, Bruck an der Mur; Peter Pacnik, Leoben; Werner Schantl, Mitterdorf; Josef Mocivnik, Judenburg, all of Austria; Hans-Jörg Müller-Späth, Kreuztal, Fed. Rep. of Germany

[73] Assignee: Böhler Pneumatik International Gesellschaft m.b.H., Kapfenberg, Austria

[21] Appl. No.: 453,503

[22] Filed: Dec. 20, 1989

[30] Foreign Application Priority Data

Dec. 29, 1988 [AT] Austria ..... 3186/88

[51] Int. Cl.[5] ..... F15B 13/042

[52] U.S. Cl. ..... 137/596.18; 137/596.2

[58] Field of Search ..... 137/596.18, 596.2

[56] References Cited

U.S. PATENT DOCUMENTS 3,437,011 4/1969 Van Gelder ..... 137/596.18 X 4,561,464 12/1985 Frantz ..... 137/596.18

*Primary Examiner*—Gerald A. Michalsky

*Attorney, Agent, or Firm*—Cushman, Darby & Cushman

[57] ABSTRACT

A counterblow—tap hole—boring machine, especially for pneumatic rammer advance, combined with a counterblow device which serves as tapping equipment and a rotator for the actuation of a bar drill or a striking bar, consisting of sliding control valves which feed the main air to the consumer and back as exhaust, whereby an additional quick action ventilating valve quickly reduces the pressure of the used air, is provided with a mobile control piston (20) disposed on the distal end of the axially sliding control valve (15), which holds a valve disk (16) and controls the main air supply, between the housing (12) and the shaft of the sliding control valve (15), whereby a separate annular piston (18) alternatingly rests against the valve fitting surface (19) and a fitting surface (29) at the control piston (20).

2 Claims, 1 Drawing Sheet

CONTROL VALVE FOR COUNTERBLOW-TAP HOLE-BORING MACHINE

Figure 1:
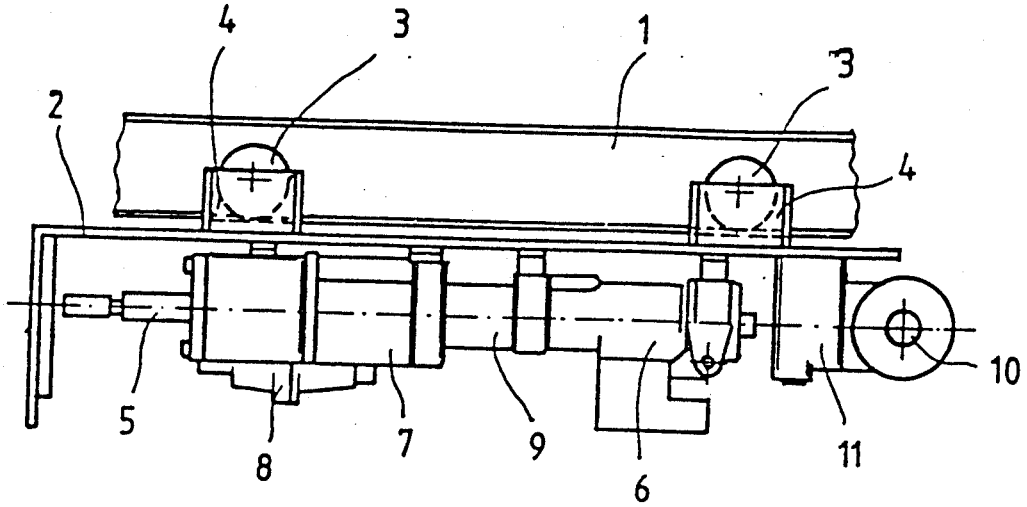

This invention concerns a control valve for a counterblow—tap hole—boring machine, especially for pneumatic rammer advance, combined with a counterblow device which serves as tapping equipment and a rotator for the actuation of a bar drill or a striking bar, consisting of sliding control valves which feed the main air to the consumer and back as exhaust, whereby an additional quick action ventilating valve quickly reduces the pressure of the used air.

A counterblow—tap hole—boring machine is used to open the mouth of a furnace on the structure of a blast furnace quickly and safely.

It is common practice to use striking bars or a pneumatic hammer or a rock drilling machine for tapping a blast furnace, so the molten pig iron may flow out. One of the shortcomings of such rock drilling machines is that they only work in one direction. Loosening and pulling of the drilling bar still is dependent on manual work. For this reason counterblow boring machines have been used which in combination with a striking hammer also allowed pulling of the drilling bar with the help of pneumatic equipment. However, this improved tapping method still had the drawback that rotation during drilling was not possible and thus required a separate rotator. These units were attached on a mounting and automated with the help of control valves. Such valves naturally have one more shortcoming; when the striking hammer, the counterblow boring machine, respectively, are turned off some after-running due to the kinetic energy in the used air is inevitable. After-running may also be caused by faulty operation. This may have grave consequences if a striking hammer and a counterblow hammer work against each other.

Based on this state of technology it is the purpose of this invention to eliminate after-running which occurs when switching from one consumer to the other, so they do not interfere with each other or destroy each other. In accordance with this invention this goal is achieved by a control valve equipped with a valve disk which can be moved axially and can close the main air supply, whereby a mobile control piston is disposed at the distal end of this control valve. In addition to this an annular piston valve alternatingly rests against the fitting surface of the valve and the fitting surface of the control piston. In this manner, the kinetic energy which remains when the valve is switched from one consumer to the other, i.e. the remaining used air which is still under pressure, can escape very quickly and thus prevents the two pistons or piston rods from striking against each other.

This is particularly advantageous if the control valve is disposed at one end in the casing cap, if its distal end runs in the control piston and if its front side bears bore holes and a groove which are effectively connected to the annular area and the control channel. This allows the remaining control air to be evacuated through the control air channel.

Furthermore, it is also advantageous if a spring is held in a groove in the front side of the sealing surfaces of the control piston and the annular piston. This keeps the two pistons from getting stuck (both of them are independent from gravity).

A variant of this device is used to describe this invention. The following items are shown:

FIG. 1 lateral view of the counterblow—tap hole—boring machine

Figure 2:
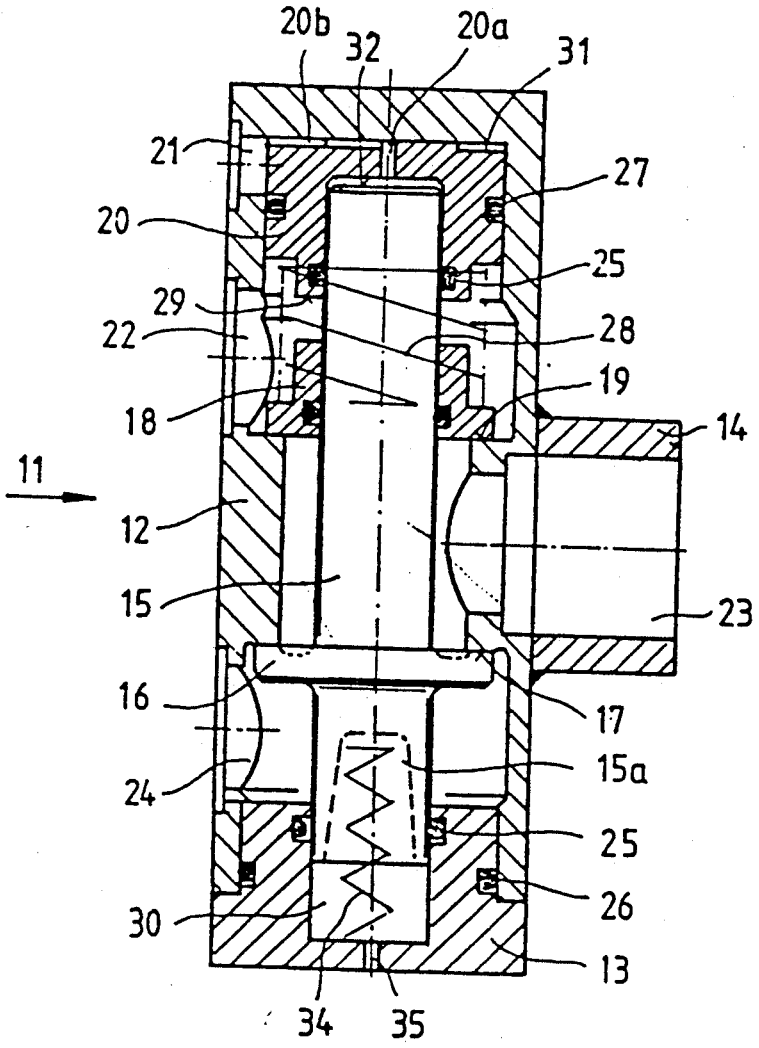

FIG. 2 Cross-section of the control valve.

FIG. 1 shows a lateral view of a counterblow—tap hole—boring machine. A mounting is suspended on rollers (3) and roller bearings (4) from a carrier (1). whereby the base plate (2) can be moved in the longitudinal direction. Striking bar 5 extends from the counterblow gear (7) and may be equipped with various tools. Rotator 8 is engaged to striking bar 5 via a gear train. Striking gear 6 is connected to counterblow gear 7 via an intermediary part (9). The individual units are connected in air supply 10, control valves 11 in particular. Striking gear 6 and counterblow gear 7 form one unit, whereby the striking surface of the pistons affect each other via the rim of intermediary part 9. The energy of a blow is conveyed from the intermediary part and the tool mounted on the front end of it to the drill bar or striking bar (5). A rotator (8) is used for drilling and for loosening the tools. Its torque is conveyed to the intermediary part (9) by an external spline. Air for both striking gears (6, 7) and the rotator is supplied by a valve block, which consists of a number of valves (11). It is crucial that all necessary control pipes are integrated in the valve block, i.e. in the casing of valves 11. This is advantageous because it eliminates the time consuming task of sealing the pipes if the device needs to be disassembled. Such a drilling unit allows the establishment of a pilot drill with a hollow drill or a cutter, exchange of the drill bar for a striking bar, piercing, and pulling by means of counterblow gear 7. This helps to ensure shorter drilling time, longer tool life for the drill bit and the cutter, and prevents the striking bar from getting stuck in the mouth of the furnace.

FIG. 2 shows a cross-section of a valve (11) whose housing (12) has a central bore which is closed with cap 13 and is sealed with ring gasket 26. In housing 12 is a hollow (12*a*) which has a fitting surface (17, 19) on each end. From this hollow 12*a* a consumption channel (23) leads to connector flange 14 onto which more continuing pipes are connected. A seal is established through an axially sliding control valve (15) with a valve disk (16) which rests against fitting surface 17. Sliding control valve 15 runs in a guide in cap 13 and is sealed with gasket ring 25, whereby the guiding area (30) and groove 15*a* house a spring (34). A channel which is disposed on the side of housing 12 serves as the main air channel (24) and is connected to the consumer channel (23) as long as valve disk 16 is in an open position. On the other end of housing 12 a control air channel (21) and a channel for used air (22) are disposed In the area of the control air channel (21), which runs along the side of housing 12, a control piston (20) is disposed. Gasket ring 27 establishes a seal toward the housing (12). There is also a pocket hole in the center which holds the axially sliding control valve (15), whereby the front side (32) is provided with some extra space and is sealed with the help of gasket ring 25. On the upper end of the control piston (20) is a protrusion so a circular area (31) remains. There is also a bore (20*a*) in control piston 20, which is connected to the circular area (31) via groove 20*b*. Furthermore, control piston 20 is provided with a fitting surface (29). Between valve fitting surface 19 and fitting surface 29 there is an area large enough to hold an annular piston (18) which can be shifted axially. It too is sealed with a gasket ring (25) against the shaft of sliding control valve 15. Channel 22 for used air is connected to this area. When no pressure applies control piston 20 and annular piston 18 are pressed apart from each other by spring 28. Control air enters circular area 31 via control air channel 21, causing the control piston to move toward the end, lifting valve disk 16 of sliding control piston 15 from fitting surface 17. The main air channel is thus connected with the consumer channel (23). The consumers, striking gear 6, counterblow gear 7, and rotator 8, start to operate. The movement of control piston 20 is limited by annular piston 18, which causes it to be pressed against fitting surface 19 of the housing (12). This prevents escape of the used air via used air channel 22. At the same time control air reaches the front side (32) of sliding control valve 15 via circular area 31 and bore 20*a*, causing the sliding control valve to open completely. The movement of sliding control valve 15 is limited by protrusion 33 in cap 13. Now the valve is completely opened. In order to prevent the formation of an air pillow in guide area 30 an evacuation hole (35) is provided.

When the force which presses against annular piston 18 via control piston 20 is eliminated the remaining air from the consumer channel (23) can lift annular piston (18) from the valve fitting area (19) and escape via the used air channel. This ensures that a consumer stops very quickly and does not interfere with the consumer that works in the other direction.

Another crucial feature is that a combination of two valves (11) allows the rotator (8) to reverse This is done in a fashion whereby one of the valves (11) is actuated and supplied with control air in the manner described above. The used air of rotator 8 is supplied to the other valve (11) via consumer channel 14. As the annular piston (18) is lifted the remaining pressure of the air flowing back can be released via used air channel 22. If the two valves (11) are supplied with control air in an alternating manner, a clockwise or counter-clockwise rotation can be achieved. This is of particular importance because no additional exhaust valve is necessary as the exhaust valve is integrated in the main air valve.

We claim:

1. A control for a counterblow—taphole—boring machine of the type having a pneumatic rammer advance, a counterblow device, and a rotator for actuating a striking bar which taps said tap hole, said valve comprising:

a slidable control valve dispersed in a housing provided with a cap to receive one end of the control valve, said valve including a valve disk intermediate its ends for controlling the flow of pressurized air introduced to said housing;

a first piston adapted to receive the end of the control valve opposite that received within said cap;

a second piston annularly disposed about said control valve and positioned between said first piston and the valve disk, said second piston being movable between a first shouldered surface within said housing and said first piston whereby when said second piston is disposed against the first shouldered surface, pressurized air is prevented from flowing as exhaust air from the housing and when the second piston is placed from said first shouldered surface towards the first piston, air is permitted to be exhausted from the housing; and air passage 'means provided in said housing and within said first piston for introducing control air to said first piston and the control valve to displace said valve and piston towards said cap whereby the disk valve is displaced from a second shouldered surface within said housing to permit pressurized air to flow to one of the pneumatic rammer advance, counterblow device and rotator.

2. A control valve as set forth in claim 1, wherein a spring is disposed within the housing to extend between said first and second pistons.

* * * * *